US006122942A

United States Patent [19]

Jung

[11] Patent Number: 6,122,942

[45] Date of Patent: Sep. 26, 2000

[54] WASHING MACHINE HAVING DUAL DAMPING STRUCTURE

[75] Inventor: Young-Jun Jung, Seoul, Rep. of Korea

[73] Assignee: Daewoo Electronics Co., Ltd., Seoul, Rep. of Korea

[21] Appl. No.: 09/219,772

[22] Filed: Dec. 23, 1998

[30] Foreign Application Priority Data

Jun. 30, 1998 [KR] Rep. of Korea ..... 98-11613

[51] Int. Cl.[7] ..... D06F 37/24

[52] U.S. Cl. ..... 68/23.3

[58] Field of Search ..... 68/23.3

[56] References Cited

U.S. PATENT DOCUMENTS

| | | | |
|---|---|---|---|
| 5,520,029 | 5/1996 | Savkar | 68/23.3 |
| 5,528,913 | 6/1996 | Savkar | 68/23.3 |
| 5,606,879 | 3/1997 | Froelicher et al. | 68/23.3 |
| 5,657,649 | 8/1997 | Lim | 68/23.3 |

FOREIGN PATENT DOCUMENTS

| | | | |
|---|---|---|---|
| 229096 | 9/1988 | Japan | 68/23.3 |
| 276298 | 10/1992 | Japan | 68/23.3 |

*Primary Examiner*—Philip R. Coe

*Attorney, Agent, or Firm*—Jacobson, Price, Holman & Stern, PLLC

[57] ABSTRACT

A washing machine having a dual damping structure can effectively prevent undesirable vibration of an outer tub by lowering the center of gravity of outer tub depending on a quantity of washing objects to stabilize the outer tub. A first damping part having a cap and a first spring is installed on the other end of a supporting rod, and dampens longitudinal vibration of the supporting rod. A second damping part having a slider and a second spring is integrally formed on a lower periphery of the outer tub. Also, there is provided a connecting means connecting the first damping part with the second damping part so as to transmit the vibration of the second damping part into the first damping part.

5 Claims, 5 Drawing Sheets

WASHING MACHINE HAVING DUAL DAMPING STRUCTURE

BACKGROUND OF THE INVENTION

1. Field of the Invention

This invention relates to a washing machine, more particularly, a washing machine having a dual damping structure, which can effectively prevent undesirable vibration by lowering the center of gravity of an outer tub depending on a quantity of washing objects and washing liquid in order to stabilize the outer tub.

2. Prior Art

Generally, washing machines are classified into a fully-automatic washing machine and a semi-automatic washing machine according to the operating manner.

As is well known, the fully-automatic washing machine carries out washing, rinsing, and dehydrating operations with washing objects in a single spin tub, so that there is no need to provide a separate dehydration tub for extracting washing liquid from the washed washing objects. On the contrary, the semi-automatic washing machine has a washing tub and a separate dehydration tub to carry out the washing and dehydrating operations, respectively.

Recently, the fully-automatic washing machines are widely being used as a household washing machine.

However, since the spin tub having relatively large volume is rotated at a high speed, the fully-automatic washing machine generates a vibration during the washing and dehydrating operations.

In particular, when the washing objects are unevenly distributed within the spin tub, an extreme vibration may be created so that not only a loud noise is generated, but also in an extreme case the washing machine moves from its initial position.

To overcome the above-mentioned problems, there has been effort to provide a fully-automatic washing machine which can prevent undesirable vibration thereof.

FIG. 1 shows such a conventional fully-automatic washing machine 300 having an assembly 330 for damping vibration.

As shown in FIG. 1, the conventional full-automatic washing machine comprises a body 305 having a plurality of projecting parts 307 formed in an upper portion of its inner wall, an outer tub 310 having a plurality of protuberances 312 formed in a lower portion of its outer wall, a spin tub 320 mounted in the outer tub 310 so as to receive washing objects, a motor 340 for rotating the spin tub 320, and a plurality of assemblies 330 for damping vibration caused by rotation of the spin tub 320.

Each of the projecting parts 307 and protuberances 312 has a hole (not shown) for fitting the vibration damping assembly 330.

The vibration damping assembly 330 includes a supporting member 332 fitted to the hole of projecting part 307 and formed with a perforated hole at a center thereof, a rod 334, one end of which is inserted in the perforated hole and the other end of which is fitted to the hole of protuberances 312, a cap 336 having an open end and disposed at an underside of protuberances 312 in order to dampen vibration of outer tub 310, and a stopper 339 inserted into the open end of the cap 336.

The conventional fully-automatic washing machine 300 has four vibration damping assemblies 300.

The operation of the conventional fully-automatic washing machine 300 being constructed as described above is as follows.

Firstly, in the event of a washing operation, when a user pushes an operating button (not shown) disposed in an upper portion of washing machine 300 on, a control unit such as micro-computer generates a signal for washing operation, and thereby the motor 340 is driven. The driving force of the motor 340 is transmitted to a pulsator 322 disposed in a lower portion of the spin tub 320 so that the pulsator 322 is rotated. As the pulsator 322 rotates, a liquid flow having a swirl shape is generated in the spin tub 320. The liquid flow that has been generated in the spin tub 320 impacts on washing objects, which have been loaded in the spin tub 320, and thereby the washing objects are washed.

Then, when the washing operation has finished, the washing liquid that has been supplied to the outer tub 310 is drained into an exterior of washing machine 300. In this state, the control unit generates a signal for a dehydrating operation, and thereby the motor 340 is driven again. At this time, the driving force of the motor 340 is transmitted to the spin tub 320 so that the spin tub 320 is rotated.

As the spin tub 320 rotates, the washing objects loaded in the spin tub 320 are subjected to centrifugal force so that the washing objects are forced radially outward of the spin tub 320, i.e., toward a side wall of the spin tub 320, and thereby the washing liquid contained in the washed washing objects is drained into an exterior of the washing machine 300 through a plurality of openings formed in the side wall of the spin tub 320.

During the washing and dehydrating operations, vibration inevitably happens in the washing machine 300. In particular, the vibration may occur more extremely during the dehydrating operation since the spin tub 320 having a relatively large size is rotated at a high speed.

To reduce the vibration, the conventional washing machine 300 comprises a plurality of vibration damping assemblies 330. The vibration damping assemblies 330 are regularly disposed around a circumference of the outer tub 310 so as to effectively dampen the vibration caused by high-speed rotation of the spin tub 320.

That is, the vibration that has been generated by rotation of the spin tub 320 or pulsator 322 is transmitted to the cap 336 of the vibration damping assembly 330, which is in contact with the protuberance 312 of the outer tub 310, through the outer tub 310. At this time, the spring 338 disposed in the cap 336 is repeatedly compressed and expanded according to the vibration so that the vibration can be dampened. The dampened vibration is transmitted to the support member 332 through the rod 334 connected to the cap 336 so that only a reduced vibration is transmitted to the body 305 of the washing machine 300.

However, the conventional automatic washing machine 300 being constructed as described above has the following disadvantages.

Firstly, because a supporting point of the vibration damping assembly 330 relative to the outer tub 310 is always fixed at a consistent position, in case of loading a large quantity of washing objects, the center of gravity of the outer tub 310 is placed at an upper portion as compared with the initial state. Therefore, the outer tub 310 is unstably supported, and thus the vibration of the outer tub 310 may not be effectively absorbed.

Further, when the washing objects are unevenly distributed within the spin tub 320, a relatively heavier vibration is transmitted to an upper portion of the body 305 of the washing machine 300 so that a loud noise may happen.

Accordingly, there has been a necessity to provide a washing machine having a dual damping structure which can effectively prevent the vibration.

THE SUMMARY OF THE INVENTION

To solve the above problems, it is a first object of the present invention to provide a washing machine having a dual damping structure so as to effectively prevent vibration of an outer tub.

It is a second object of the present invention to provide a washing machine having dual damping structure, which can effectively prevent an undesirable vibration by vertically moving a supporting point of a damping device relative to an outer tub depending on a quantity of washing objects and washing liquid to stabilize the outer tub.

To obtain these objects, a washing machine having a dual damping structure according to a preferred embodiment of the present invention comprises a cabinet encasing the washing machine outside; an outer tub mounted in the cabinet; a supporting rod one end of which is supported on an upper end of the cabinet and the other end of which forms a stopper; a first damping part including a cap having an opening end slidably engaged with the stopper and of which a supporting rod passes through the central portion of the cap, and a first spring received in the cap, surrounding the supporting rod, and one end of which is supported by the stopper; a second damping part including a housing integrally formed with the outer tub and forming a slot corresponding with the longitudinal direction of the supporting rod, a second spring received in the housing, and a slider biased toward one end of the slot by the second spring and vertically sliding in the housing; and an operating bar, one end of which is integrally formed with the slider in the housing, and the other end of which forms a supporting hole for supporting the supporting rod in the central portion.

The operation of the washing machine having the dual damping structure according to the present invention being constructed as described above is as follows.

Firstly, when the washing machine is filled with a large quantity of the washing objects and washing liquid, the heavy load is applied to the outer tub and thus the outer tub moves into a lower portion of the cabinet. At this time, the second damping part integrally formed with the outer tub moves toward the lower portion of the cabinet, so that the slider compresses the second spring and then the operating bar integrally formed with the slider is placed on the upper portion of the slot. The first damping part additionally absorbs vibration transmitted from the second damping part.

As described above, because the operating bar is placed on the upper portion of the slot, the supporting point of the operating bar relative to the outer tub moves into the upper portion of the outer tub, thereby the outer tub maintains the stable state. If the outer tub is stable, vibration of the outer tub is generated less than in an unstable state.

Accordingly, if the vibration is generated on the outer tub by means of the operation of the washing machine, as mentioned above, the first damping part and the second damping part perfectly absorb the undesirable vibration.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE REFERRED EMBODIMENT

Hereinafter, a first preferred embodiment according to the present invention will be described in detail with reference to the drawings.

Figure 1:
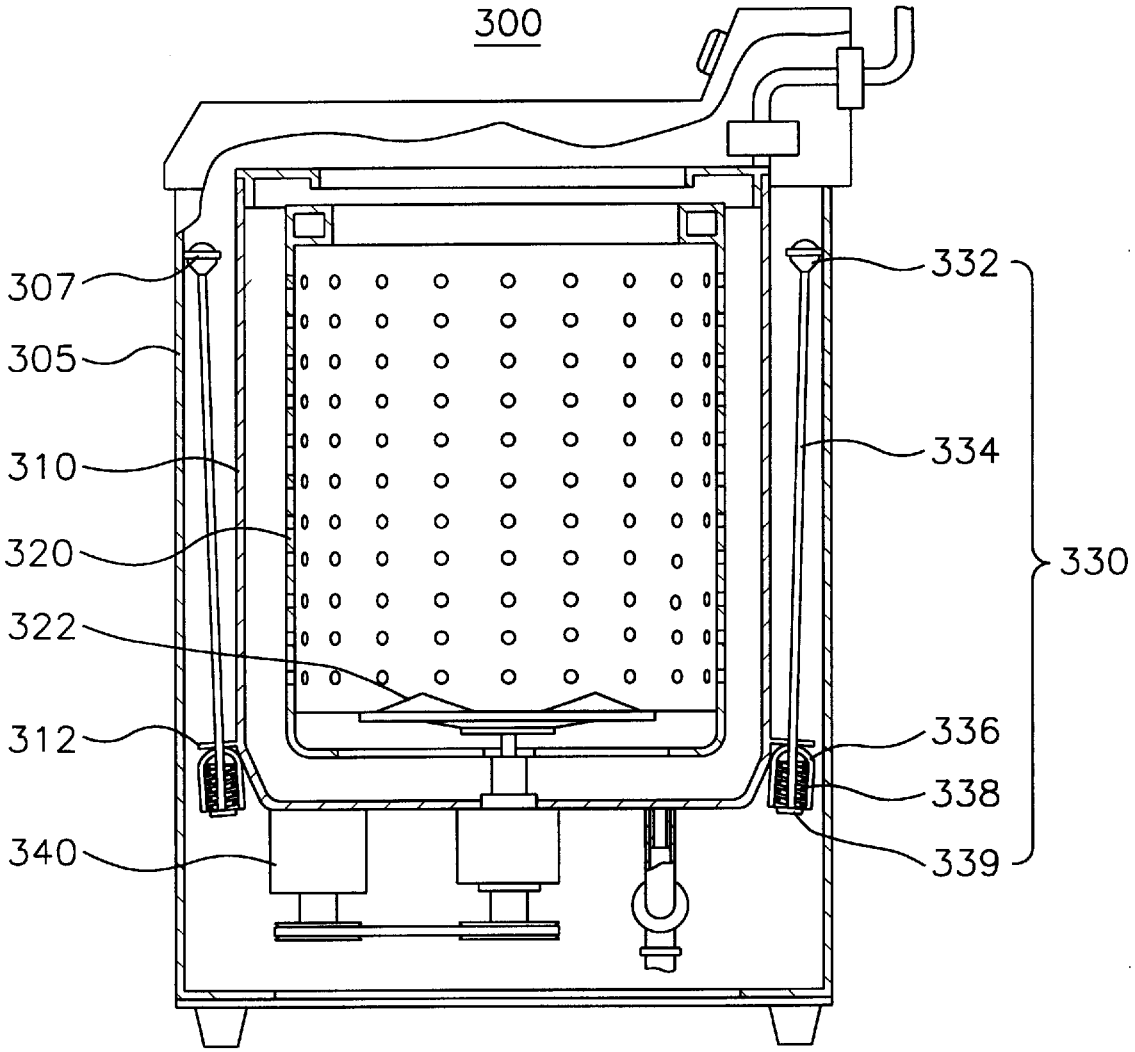
FIG. 1 PRIOR ART
FIG. 1 is a sectional view showing a conventional washing machine having a vibration damping assembly.
Figure 2:
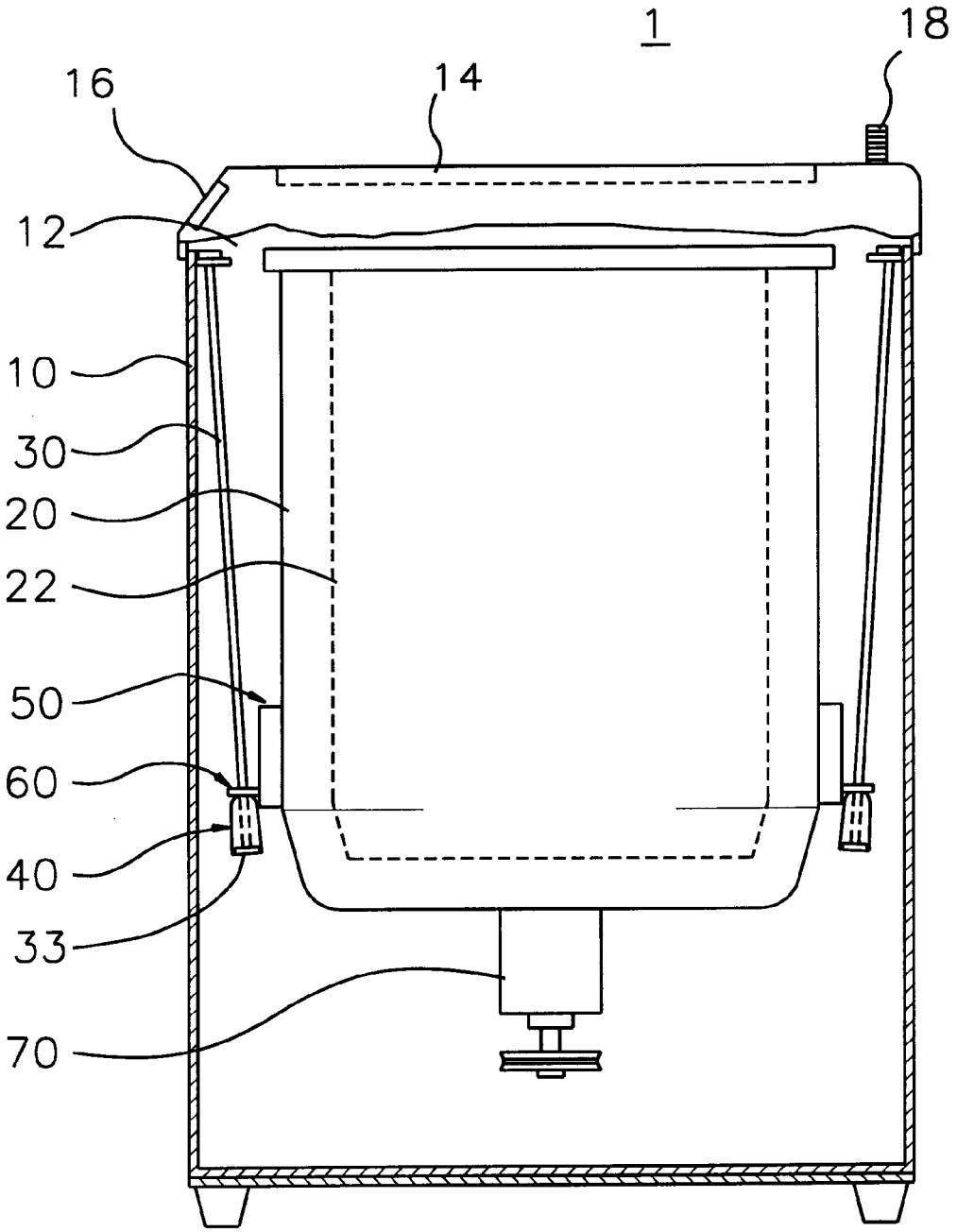
FIG. 2 is a sectional view showing a washing machine having a dual damping structure according to a preferred embodiment of the present invention.

FIG. 2 is a sectional view showing a washing machine having a dual damping structure according to a preferred embodiment of the present invention.

As shown in FIG. 2, a washing machine 1 having a dual damping structure according to a preferred embodiment of the present invention is enclosed with a cabinet 10, and an inlet port 12 is formed at the upper portion of the cabinet 10. The inlet port 12 may be opened and closed by a door 14, and a control panel 16 for controlling the operation of the washing machine is installed in an upper front of the cabinet 10. A water-feeding valve 18 by which washing liquid flows is installed in the upper rear of the cabinet 10.

Furthermore, an outer tub 20 storing washing liquid entered through the water-feeding valve is installed in the cabinet 10, and a spin tub 22 for washing the washing objects is rotatably installed in the outer tub 20. The spin tub 22 is rotated through a driving force of the spin tub 22.

In addition, a damping device which absorbs vibration of the outer tub 20 generated in a washing operation and a dehydrating operation is provided in the washing machine. The damping device comprises a supporting rod 30, a first damping part 40 absorbing the vibration of the outer tub 20, a second damping part 50 integrally formed on a lower periphery of the outer tub 20 for moving the center of gravity of the outer tub 20 depending on a quantity of the washing objects and washing liquid, and a connecting means connecting a first damping part 40 with a second damping part 50.

One end of the supporting rod 30 is supported on an upper end of the cabinet 10, and the other end thereof is connected to the first damping part 40 by the stopper 33.

Figure 3:
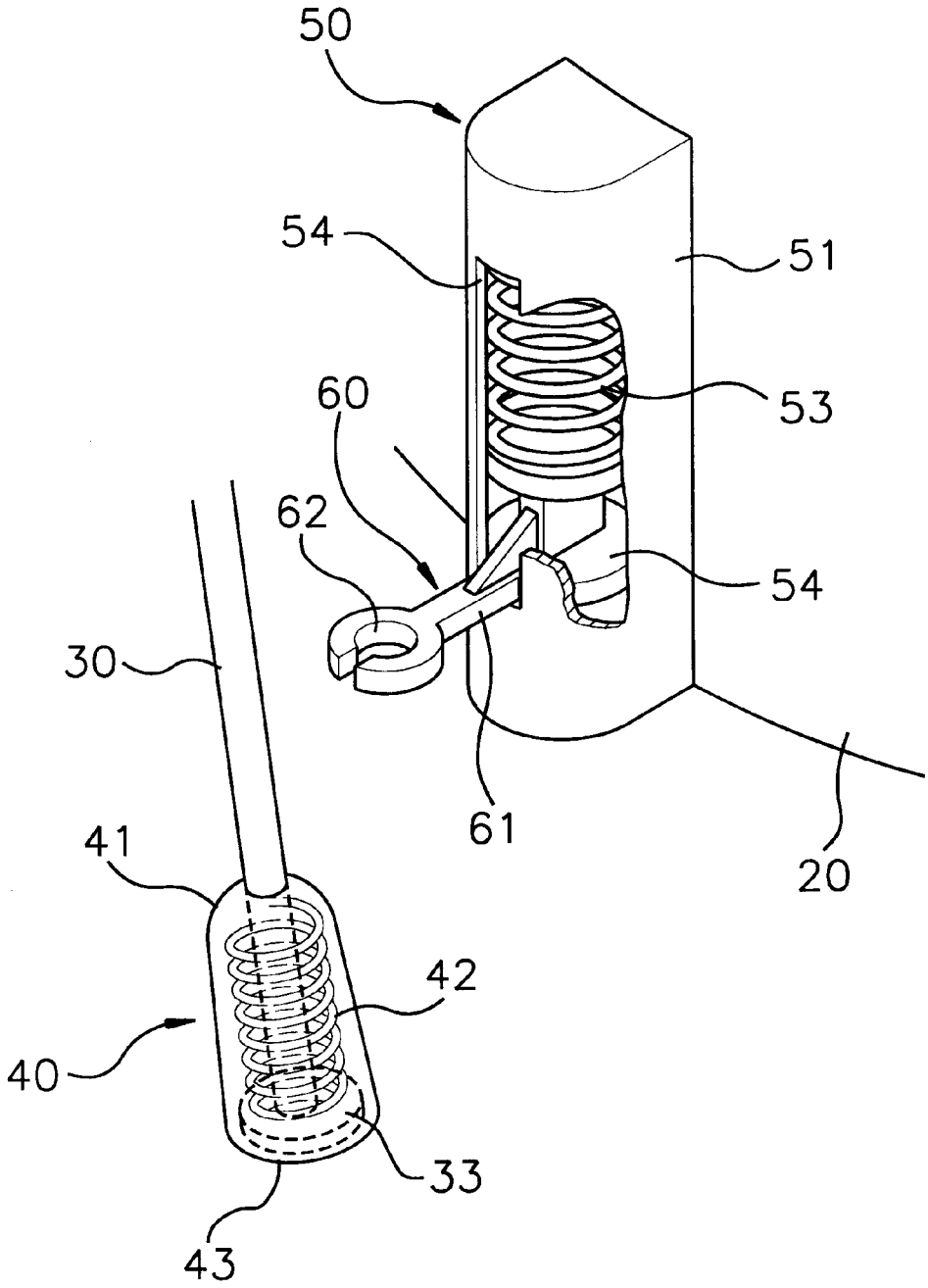
FIG. 3 is an exploded perspective view, partly broken away, of the dual damping structure shown in FIG. 2.

FIG. 3 is an exploded perspective view, partly broken away, of the dual damping structure according to the preferred embodiment of the present invention.

As shown in FIG. 3, the first damping part 40 having a cap 41 and a first spring 42 is mounted on the other end of the supporting rod 30, and dampens a longitudinal vibration of the supporting rod 30. The supporting rod 30 passes through a central portion of the cap 41 and the stopper of the supporting rod 30 is slidably embedded in an opening portion 43 of the cap 41. Also, the first spring 42 is received in the cap 41, surrounding the supporting rod 30, and one end of which is supported on the stopper 33.

The second damping part 50 is formed at a lower periphery of the outer tub 20, and dampens the vibration of the outer tub 20. A housing 51 of the second damping part 50 is integrally formed on the outer tub 20, and a slot 54 corresponding to the longitudinal direction of the supporting rod 30 is formed on the housing. Also, a second spring 53 for damping the vibration of the outer tub 20 and a slider 52 movable upward and downward is mounted in the housing 51. The slider 52 is biased toward one end of the slot 54 by the second spring 53.

Furthermore, the connecting means is formed by an operating bar 61 vertically movable along the slot 54. One end of the operating bar 61 is integrally formed with the slider 52 in the housing 51, and the other end of which forms a supporting hole for supporting the supporting rod at the central portion.

Preferably, the dual damping structure being constructed as described above may be placed at four positions spaced at equal intervals on the lower periphery of the outer tub 20.

Hereinafter, the operation of the first preferred embodiment according to the present invention will be described.

Figure 4A:
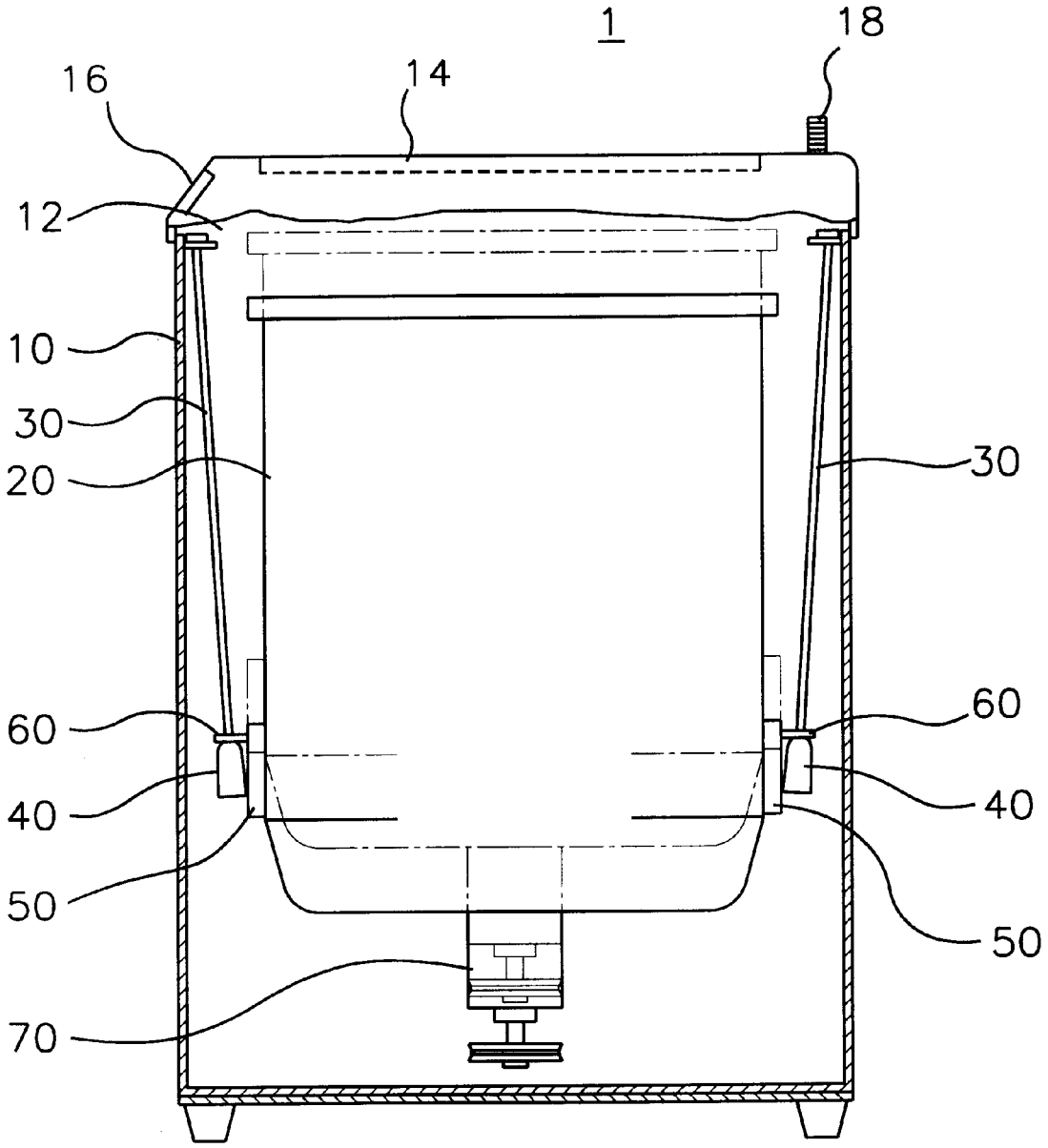
FIG. 4A is a sectional view schematically showing a transitional state of an outer tub in the washing machine having the dual damping structure according to the preferred embodiment of the present invention.

FIG. 4A is a sectional view schematically showing a transitional state of an outer tub in the washing machine having the dual damping structure according to the preferred embodiment of the present invention, and FIG. 5 is a sectional view showing an operating state of the dual damping structure of FIG. 4.

Figure 4B:
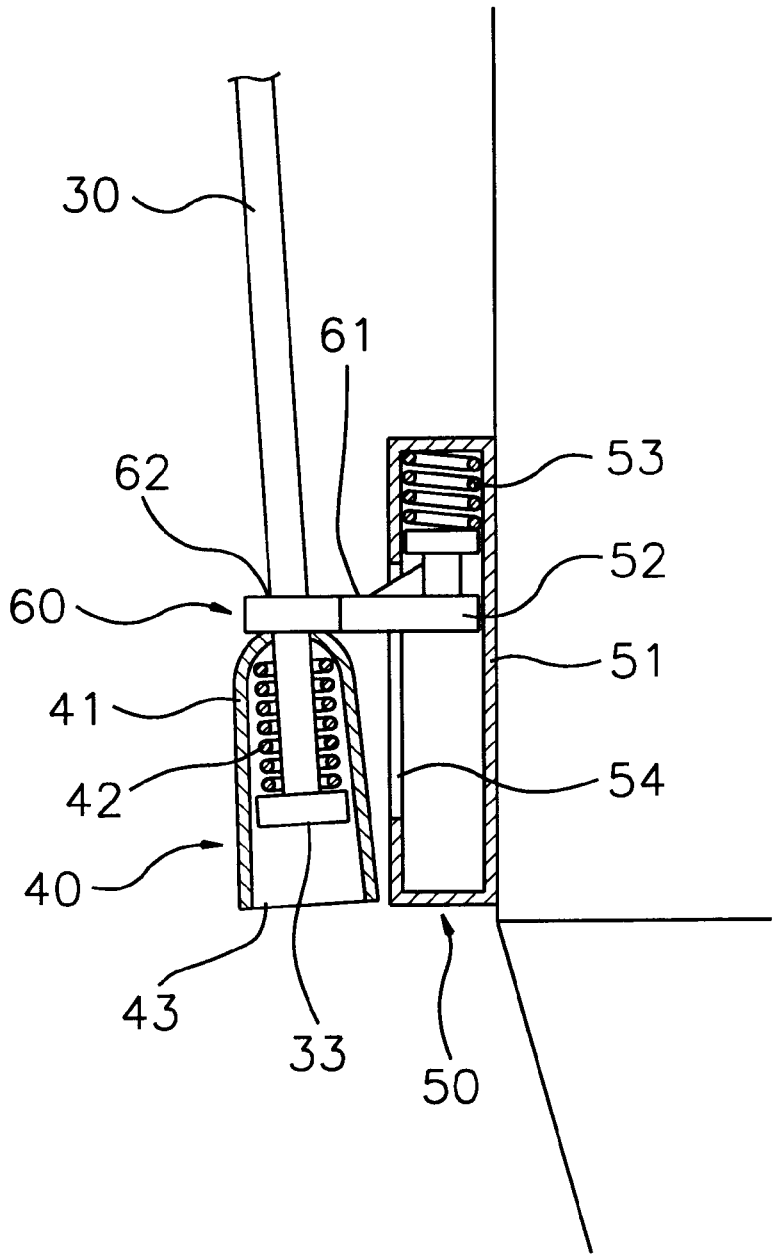
FIG. 4B is a sectional view showing an operating state of the dual damping structure of FIG. 4A.

As shown in FIG. 4A and FIG. 4B, when the washing machine 1 having the dual damping structure according to a preferred embodiment of the present invention is filled with a small quantity of the washing objects and washing liquid, the small load is applied to the outer tub 20 and thus the outer tub 20 does not greatly move into a lower portion of the cabinet 10. At this time, if the vibration is generated on the outer tub 20 by means of the operation of the washing machine 1, the second spring 53 of the second damping part 50 absorbs the vibration of the outer tub 20 while the first spring 42 of the first damping part 40 additionally absorbs the vibration.

Furthermore, when the washing machine 1 is filled with a large quantity of the washing objects and washing liquid, the heavy load is applied to the outer tub 20 and thus the outer tub 20 moves into a lower portion of the cabinet 10. At this time, the second damping part 50 integrally formed with the outer tub 20 moves toward the lower portion of the cabinet 10, so that the slider 52 compresses the second spring 53 and then the operating bar 61 integrally formed with the slider 52 is placed on the upper portion of the slot 54. The first damping part 40 additionally absorbs vibration transmitted from the second damping part 50.

As described above, because the operating bar 61 is placed on the upper portion of the slot 54, the supporting point of the operating bar 61 relative to the outer tub 20 moves into the upper portion of the outer tub 20, thereby the outer tub 20 maintains a stable state. If the outer tub 20 is stable, vibration of the outer tub 20 is generated less than in an unstable state.

Accordingly, if vibration is generated on the outer tub 20 by means of the operation of the washing machine 1, as mentioned above, the first damping part 40 and the second damping part 50 efficiently absorb the undesirable vibration.

In addition, when the operating bar 61 is placed at the highest position of the slot 54, if the weight of the outer tub 20 is heavier due to additional washing objects and washing liquid, the operating bar 61 presses the cap 41 of the first damping part downward. The cap 41 moves downward while the first spring 42 is compressed through the stopper 33. As a result, the outer tub 20 moves into a position lower than the moving position of the second damping part 50, which maintains a stable state.

As mentioned above, the washing machine having the dual damping structure according to the present invention doubly absorbs the vibration of the outer tub 20 through the dual damping structure, while being capable of vertically moving the supporting point of the damping device relative to the outer tub 20 depending on the washing objects and the washing liquid. Thus, the washing machine 1 substantially stabilizes the outer tub 20 in the washing operation and the dehydrating operation, and prevents the undesirable vibration.

While this invention has been particularly shown and described with reference to particular embodiments thereof, it will be understood by those skilled in the art that various changes in form and detail may be effected therein without departing from the spirit and scope of the invention as defined by the appended claims.

What is claimed is:

1. A washing machine having a dual damping structure comprising:

a cabinet enclosing the washing machine;

an outer tub mounted in the cabinet;

a supporting rod one end of which is supported on an upper end of the cabinet and the other end of which forms a stopper;

a first damping part installed on the other end of the supporting rod and damping longitudinal vibration of the supporting rod;

a second damping part formed on a lower peripheral surface of the outer tub and damping vibration of the outer tub; and a connecting means connecting the first damping part with the second damping part so as to transmit the vibration of the second damping part into the first damping part.

2. The washing machine having a dual damping structure according to claim 1, wherein said first damping part comprises:

a cap having an opening end slidably engaged with the stopper and a central portion through which the supporting rod passes; and a first spring received in the cap, surrounding the supporting rod, and one end of which is supported by the stopper.

3. The washing machine having a dual damping structure according to claim 2, wherein said second damping part comprises:

a housing integrally formed with the outer tub and forming a slot corresponding with the longitudinal direction of the supporting rod;

a second spring received in the housing; and a slider biased toward one end of the slot by the second spring and vertically sliding in the housing.

4. The washing machine having a dual damping structure according to claim 3, wherein said connecting means is an operating bar, one end of which is integrally formed with the slider in the housing, and the other end of which forms a supporting hole for supporting the supporting rod, wherein the supporting rod passes through the supporting hole.

5. A washing machine having a dual damping structure comprising:

a cabinet encasing the washing machine;

an outer tub mounted in the cabinet;

a supporting rod one end of which is supported on an upper end of the cabinet and the other end of which forms a stopper; a first damping part including a cap having an opening end slidably engaged with the stopper and a central portion through which the supporting rod passes;

a first spring received in the cap, surrounding the supporting rod, and one end of which is supported by the stopper;

a second damping part including a housing integrally formed with the outer tub and forming a slot corresponding with the longitudinal direction of the supporting rod, a second spring received in the housing and a slider biased toward one end of the slot by the second spring and vertically sliding in the housing; and an operating bar one end of which is integrally formed with the slider in the housing, and the other end of which forms a supporting hole for supporting the supporting rod in the central portion.

* * * * *